United States Patent [19]

AmRhein

[11] Patent Number: 4,996,983

[45] Date of Patent: Mar. 5, 1991

[54] INHALER FILTRATION DEVICE WITH HOUSING SUPPORTABLE BY SPECTACLE TEMPLE

[76] Inventor: Floyd E. AmRhein, R.R. 1, Box 143C, Scipio, Ind. 47273

[21] Appl. No.: 304,240

[22] Filed: Jan. 31, 1989

[51] Int. Cl.[5] ..... A62B 7/10

[52] U.S. Cl. ..... 128/206.11; 128/205.29; 128/207.18; 128/DIG. 26

[58] Field of Search ..... 128/205.27, 205.29, 128/206.11, 206.13, 206.15, 206.18, 207.16, 207.18, 205.24, DIG. 26

[56] References Cited

U.S. PATENT DOCUMENTS

| | | | |
|---|---|---|---|
| 769,755 | 9/1904 | Madsen | 128/205.24 |
| 781,516 | 1/1905 | Guthrie, Jr. | 128/206.18 |
| 853,431 | 5/1907 | Allen | 128/207.18 |
| 1,443,820 | 1/1923 | Hudson | 128/205.29 |
| 2,168,705 | 8/1939 | Francisco et al. | 128/207.18 |
| 2,865,369 | 12/1958 | Kline | 128/207.16 |
| 3,209,755 | 10/1965 | McCarthy et al. | 128/DIG. 26 |
| 4,465,067 | 8/1984 | Kock et al. | 128/207.18 |
| 4,559,941 | 12/1985 | Timmons et al. | 128/207.18 |
| 4,708,446 | 11/1987 | Timmons et al. | 128/207.18 |

*Primary Examiner*—Edgar S. Burr
*Assistant Examiner*—Aaron J. Lewis
*Attorney, Agent, or Firm*—Woodard, Emhardt, Naughton, Moriarty & McNett

[57] ABSTRACT

A filtration device having a housing which may be attached to and supported by the temple of a set of spectacles worn by a wearer. The filtration device is operable to filter air inhaled through the nostril of the wearer, and comprises a generally elongated housing having a length about equal to or less than the length of the temple of the spectacles, the housing also having at least one dirty air inlet opening and a clean air outlet opening at a spaced position therefrom. A filter element is received within the housing and is operable to filter air moving therethrough. Attachment means for selectively attaching and detaching the housing to the temple of a pair of spectacles are also provided, as are conduit means extending between the outlet opening of the housing and at least one nostril of the wearer so that the air inhaled by the wearer through the nostril passes through the housing. In a preferred embodiment, two filtration housings are provided and each may be attached to a separate spectacle temple, and the conduit means include a nose plug element having two nasal plugs, each of which is connected to a clean air outlet opening of a respective filtration device via flexible tubing. In other preferred embodiments, the filtration device also includes one-way valves to restrict the direction of airflow through the housings, and/or one-way valves operable to exhaust exhaled gases.

23 Claims, 4 Drawing Sheets

INHALER FILTRATION DEVICE WITH HOUSING SUPPORTABLE BY SPECTACLE TEMPLE

BACKGROUND OF THE INVENTION

The instant invention pertains generally to filtration devices, and more particularly to a filtration device having a housing which may be attached to and supported by the temple of a pair of spectacles worn by a wearer, the device being operable to filter air inhaled by the wearer.

The continued presence of air pollution in our cities, as well as the commonplace occurrence of hazardous airborne materials in our work environments, have sparked a growing concern about the quality of the air we breathe. While there are ongoing efforts to remove or otherwise ameliorate such hazards from our environment, those efforts have yet to fully succeed. Consequently, many persons may choose or be forced to resort to some means of purifying the air they breathe. In reviewing the prior art in this area, however, it becomes evident that there exists a lack of efficient filtration devices of such general applicability and adaptability that they are suitable for large-scale consumer use. The prior art devices encountered by applicant, rather, are adapted to particular uses and situations, and are most often concerned with the administration of selected gaseous materials rather than with the filtration of environmental gases.

For instance, U.S. Pat. No. 853,431 to Allen discloses an inhaler device for the administration of anesthetics to a patient. The Allen device is held in place by an elastic band surrounding the head of the user, and is connected to a bag which is adapted to afford a supply of inhalant to the patient. Other devices which are concerned with the administration of selected materials are described in U.S. Pat. Nos. 2,168,705 to Francisco et al., and 4,465,067 to Koch et al. The Francisco device includes a supporting frame somewhat in the nature of the frame of spectacles, with nasal tubes extending downwardly therefrom. As provided in the Francisco patent, the nasal tubes are ultimately in fluid connection with an oxygen supply. Similarly, the Koch patent discloses an oxygen insufflation device which includes a head-engaging frame similar to a spectacle frame. The Koch device, however, like that of Francisco, is connected to a supply of oxygen and is concerned with the administration of that specific material rather than with the filtration of environmental gases.

U.S. Pat. Nos. 4,559,941 and 4,708,446, both to Timmons, relate to nasal tubes which are attached to a glasses frame with nasal inserts coming off the bridge portion and extending by tubes along the shaft of the glasses. As with the patents previously described herein, however, the devices described in the Timmons patents are concerned with the administration of particular gaseous materials, for instance oxygen, rather than with the filtration of environmental gases.

U.S. Pat. No. 781,516 to Guthrie discloses a device for attachment to the human face in order to permit the subject to breathe air from other rooms or purified air. The Guthrie patent discloses an embodiment which includes purifying attachments which have small hairs or follicles to help to purify inhaled air. The purifying attachments of Guthrie, however, are located along tubes which simply extend outwardly from the nostrils, which may be unsightly and which does not provide the adaptability of the applicant's invention.

U.S. Pat. No. 769,755 to Madsen discloses a breathing apparatus particularly designed for the use of firemen to prevent suffocation by smoke or of other persons who may be compelled to remain in rooms or other places filled with smoke or other noxious fumes or gases. In Madsen, a reservoir charged with fresh air is carried by the subject and is attached by air tubes to a mouthpiece. This design is particularly unsuitable for large-scale consumer use owing to its bulk and the necessity of refilling the reservoir with fresh air after the same has been depleted.

Thus, in light of the prior art devices known by applicant, there exists a need for an efficient filtration device of such general applicability and adaptability that it is suitable for large-scale consumer use. The applicant's invention addresses this need.

SUMMARY OF THE INVENTION

The instant invention generally provides a filtration device having a housing which may be attached to and supported by the temple of a pair of spectacles worn by a wearer. The device is operable to filter air inhaled through the nose of the wearer, and comprises a generally elongated housing having at least one dirty air inlet opening and a clean air outlet opening at a spaced position therefrom. A filter element is received within the housing and is operable to filter air moving therethrough. Attachment means, such as a clip, for selectively attaching and detaching the housing to the temple of a pair of spectacles are also provided, as are conduit means, such as flexible tubing, extending between the clean air outlet opening of the housing and the nostrils of the wearer. The conduit means are adapted and positioned such that the air inhaled by the wearer passes through the housing and is thus filtered prior to entering the nose of the wearer.

In a preferred embodiment, two filtration housings are provided and each may be attached to a separate spectacle temple, and the conduit means includes a nose plug element having two nasal plugs, each of which is ultimately fluidly connected to a clean air outlet opening of at least one filtration housing via flexible tubing. In other preferred embodiments, the filtration device also includes a one-way valve to restrict the direction of airflow through the housing, and/or a one-way valve operable to exhaust exhaled gases.

DESCRIPTION OF THE PREFERRED EMBODIMENT

Figure 1:
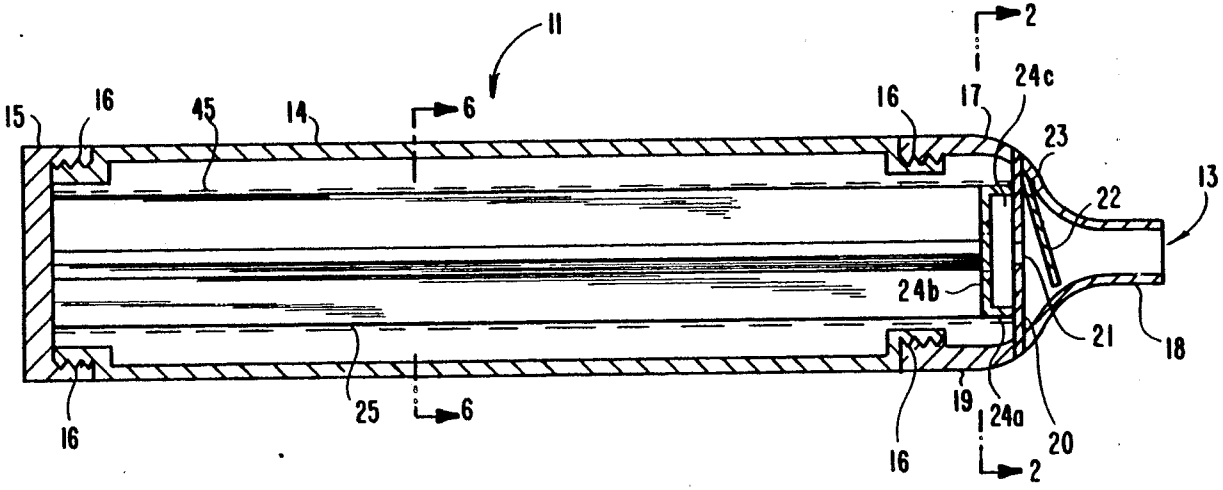
FIG. 1 is a cross-sectional view of a housing of a pod filter device.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, shown is a cross-sectional view of a filtration housing 11 of a preferred inhaler filtration device. The housing 11 includes a body 14, with a cap element 15 removably attached to one end, and a flute element 17 removably attached to the opposite end of the body 14. As illustrated in FIG. 1, the removable attachment of the cap element 15 and the flute element 17 to the body 14 may be accomplished by including corresponding threads in their structures, such as at locations designated as 16; however, other means of attachment known in the art could be used, including, for instance, means for snapping these items together, and are within the scope of the invention herein.

Figure 6:
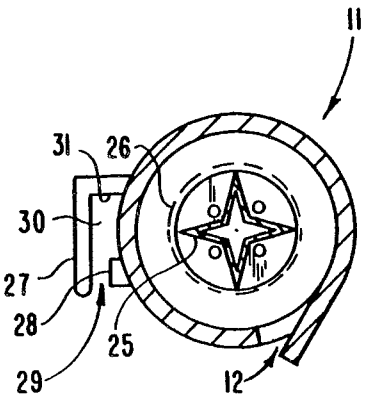
FIG. 6 is a left-end view of the housing of FIG. 1 taken along line 6—6 and viewed in the direction of the arrows.
Figure 7:
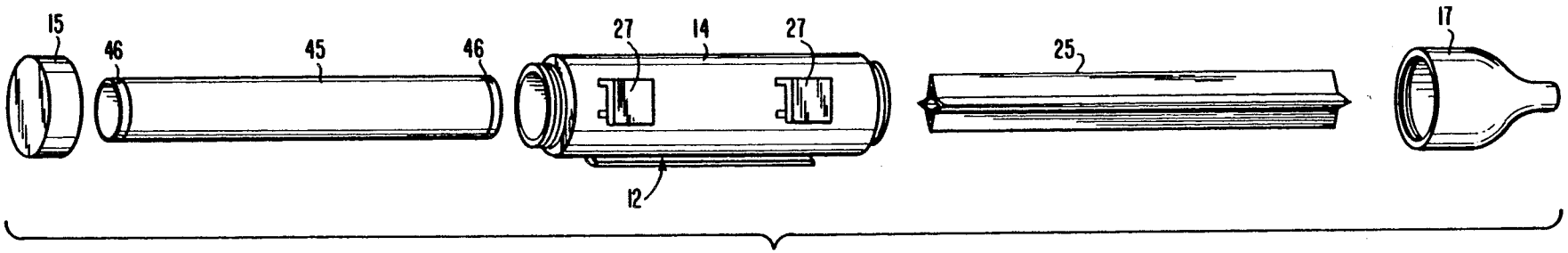
FIG. 7 is an exploded view of a filtration housing according to the present invention and including a filter element to be received in said housing.

Referring now to FIGS. 1, 6 and 7 together, in the preferred embodiment, to form an inlet opening 12 (FIGS. 6 and 7), the wall of the body 14 does not form a cylinder along its full length, but rather is slit and slightly pulled back along some of its length in order to form a slot to function as the inlet opening 12. Thus, along at least a portion of its length, the body 14 is characterized by generally having a "scroll" shape as opposed to being a cylinder. It is understood, however, that this is only the preferred embodiment, and that the body 14 could be, for instance, generally cylindrically shaped along its full length, with circular or other shaped openings therein to provide inlet openings.

Figure 2:
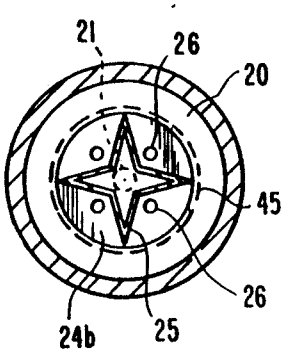
FIG. 2 is a left-end view of the housing of FIG. 1 taken along line 2—2 and viewed in the direction of the arrows.

Referring now particularly to FIGS. 1, 2 and 7 together, the wall of the flute element 17, which generally forms part of the outer wall of the housing 11, has a generally tapered structure starting from a section of smaller diameter, as at 18 (FIG. 1), and tapering outwardly to a larger diameter, as at 19 (FIG. 1). In a preferred embodiment, the flute element 17 also includes an inner wall 20 having at least one generally centrally located aperture 21 therein. The inner wall 20 is generally circular in shape and spans at least the entire inner diameter of the flute element 17 where the inner wall 20 is located. Thus, except for through the aperture 21, the inner wall blocks off fluid communication between points within the housing 11 and the outlet opening 13.

Additionally, in the preferred embodiment, a directional one-way valve means is provided and is operable to allow the passage of gases in a direction from the dirty air inlet opening 12 to the clean air outlet opening 13 of the housing 11, but to restrict the flow of fluid in the opposite direction. The one-way valve means may be a simple diaphragm-type one-way valve, as wherein a diaphragm 22, which is generally larger than the aperture 21, is held generally concentrically thereover by a rivet or the like, as at 23. The diaphragm 22 in such an arrangement may be constructed of rubber or another suitable material, and is disposed away from the inner wall 20 as gases are inhaled, but is moved toward and against the inner wall 20 and covering the aperture 21 by gases moving in a direction back into the housing 11 from the clean air outlet opening 13 and thus preventing the same.

Other suitable one-way valves are known in the art and could be used in the instant invention, such as, for instance, floating ball-type one-way valves. For a discussion of certain types of one-way valves which could be used in the instant invention, reference may be had to U.S. Pat. Nos. 2,865,369, 853,431, and 769,755, which are hereby and herewith incorporated by reference in all aspects pertinent and material to the invention herein.

Referring now to FIGS. 1 and 2 together, one end of a relatively short segment of cylindrical wall **24*a* is fixedly and sealingly attached about its periphery to the inner surface of the inner wall 20. The other end of the cylindrical wall 24*a* is capped by a generally circular wall 24*b*. The circular-wall 24*b* has four holes 26 in it (more clearly illustrated in FIG. 2), which provide fluid connection between the inlet opening (12 of FIGS. 6 and 7) and a space 24*c* (FIG. 1) defined by the circular wall 24*b*, the cylindrical wall 24*a*, and the inner wall 20, and ultimately, provide fluid connection through the aperture 21, to the outlet opening 13 (more clearly illustrated in FIG. 1**).

Referring now to FIGS. 1, 2, 6 and 7 together, the flute element 17 also includes a support rod 25 for supporting a filter element 45, which support rod 25 is fixedly attached at one of its ends to the inner surface of the circular wall **24*b*. Thus, when the flute element 17 is attached to the body 14, the support rod 25 extends into the same. In the preferred embodiment, the support rod 25 has four radially extending tapered arms, and thus, when viewed on end (as shown in FIGS. 2 and 6), appears generally of the shape of a four-point star. This preferred support rod 25 is attached to the inner surface of the cap element 24 such that the four radially extending tapered arms of the rod 25 extend between and thus do not cover up the apertures 26 in the cap-shaped element 24 (as also shown in FIGS. 2 and 6**).

Received withing the housing 11 is a generally tubular-shaped filter element 45 (shown by dotted lines FIGS. 1, 2 and 6), which may be slipped over the support rod 25 and advanced into the housing 11. The filter element 45 is operable to filter gases passing through the housing 11 and may be constructed of any material suitable therefor. Common materials utilized for such purposes are generally fibrous paper-type or spongy materials, although other types of suitable materials are known in the art and could be used in the invention herein. In a preferred embodiment, the filter element 45 may be of fluted construction as known in the art. Additionally, the filter element 45 may be recyclable; however, in a preferred embodiment the filter element 45 is disposable, and, when it has become soiled from use or otherwise, the cap 15 may be unscrewed or otherwise unattached from the body 14, and the filter element 45 may simply be slipped off of the support rod 25 and out of the housing and then discarded. An unsoiled filter element 45 may then be provided and inserted into the housing 11.

In this regard, to assure that gases passing through the housing 11 and out the clean air outlet 13 are passed through the filter element 45, the filter element 45, cap 15, flute element 17, and body 14, are constructed such that when the filter element 45 is inserted into the housing 11, and the cap 15 is screwed on or otherwise attached to the body 14, the cap 15 exerts pressure on and substantially seals against the proximal end of the filter element 45, thus compressing and substantially sealing the distal end of the filter element 45 against the inner wall 20 of the flute element 17. In such a manner, fluid communication between the dirty air inlet opening 12 of the housing 11 and the clean air outlet opening 13 is established only through the filter element 45. In this regard, to aid in forming the seals at the ends of the received filter element 45, the ends of the same may be provided with gaskets 46 or the like. The gaskets 46 can be made of rubber or any other suitable material known in the art.

Particular reference will now be made to FIG. 6 to describe a clip means for selectively attaching and detaching the housing 11 to and from the temple of a pair of ordinary spectacles. The clip means includes a longer generally L-shaped piece 27, and a shorter base piece 28, each of which may be attached to the side of the housing 11 by gluing or other suitable means. Alternatively, the L-shaped piece 27 and the base piece 28 may be constructed as part of the housing 11. The L-shaped piece 27 and the base piece 28 are configured and positioned such that they form a slot 29 which is generally more narrow than the temple of an ordinary set of spectacles. However, the L-shaped piece 27 is constructed so that it is sufficiently resilient to bend outwardly from the base piece 28 thus allowing a spectacle temple to be slipped through the slot 29 and into the receiving area 30, whereafter the L-shaped piece 27 snaps back toward the base piece 28 thus holding the housing 11 firmly on the spectacle temple. For increased stability, two or more of the clip means may be provided at spaced positions along the body 14 of the housing 11 (as generally illustrated in FIG. 7). To provide additional stability, the inner surfaces 31 of the L-shaped piece 27 may be constructed of, or otherwise provided with, material which resists slippage along the temple of a pair of spectacles. Rubber or similar material is commonly suitable for such purposes.

Figure 3:
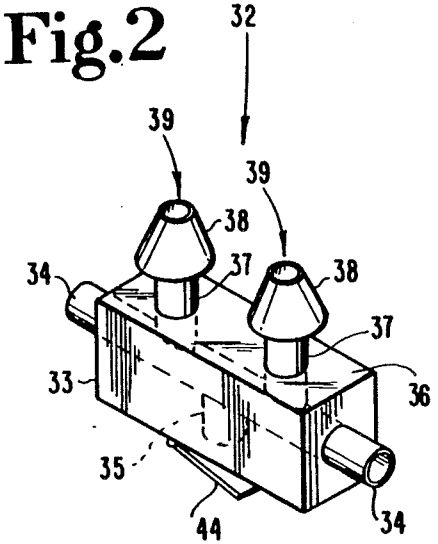
FIG. 3 is a perspective view of a nose plug element which can be used with a dual housing filtration unit.

Referring now to FIG. 3, shown is a perspective view of a nose plug element 32 of the applicant's preferred pod filter device, which can be used when two filtration housings, one for each temple of a pair of spectacles, are used (a dual housing filtration device). The plug element 32 includes a generally rectangularly-shaped block 33 having coupling members 34 extending outwardly from two of its opposed sides. The coupling members 34 are hollow and generally cylindrical in shape and each opens into a channel extending horizontally through the block 33 and fluidly connecting the coupling members 34 to each other. To the upper surface 36 of the block 33 are attached two hollow cylindrically-shaped plug tubes 37. Each plug tube 37 opens into a downwardly extending channel within the block 33, and the downwardly extending channels each in turn open into said horizontal channel. Sealingly attached to the end of each plug tube 37 is a generally conically-shaped channeled nasal plug 38. The nasal plugs 38 provide nasal openings 39 into the nasals of a wearer of the device, and are preferably constructed of a soft, non-allergenic, rubbery material, which promotes durability and comfort in wear. Additionally, in a preferred embodiment, a venting one-way valve means 44 is associated, via its own channel 35, to said horizontal channel within the block 33. The venting one-way valve means 44 may be diaphragm-type valve means similar to that describe above, or any other suitable one-way valve means known in the art.

Figure 4:
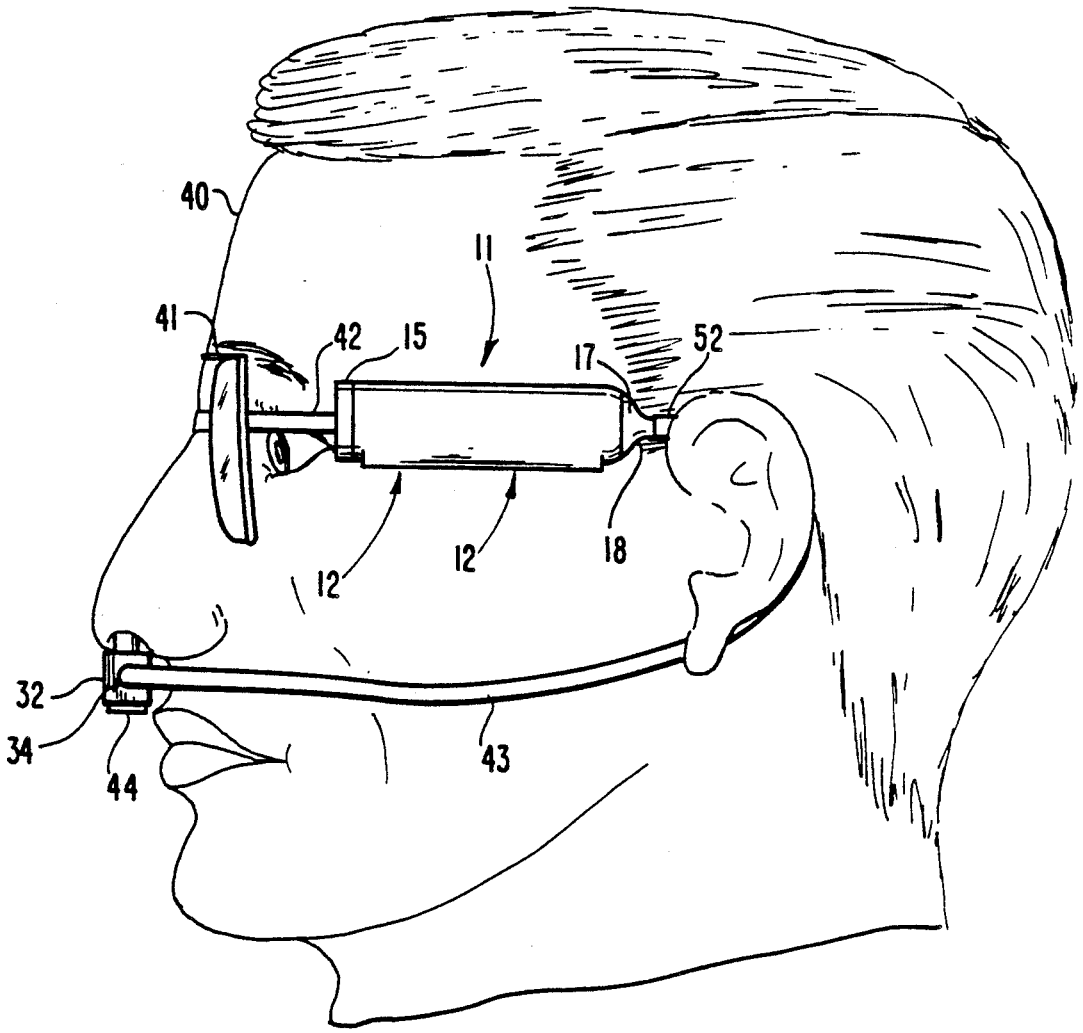
FIG. 4 is a side view of a person wearing spectacles and a dual housing filtration unit.

Referring now to FIG. 4, shown is a side view of a wearer 40 of a dual housing filtration device. It is understood that in the following discussion corresponding components are included on the opposite side of the wearer 40. The wearer 40 is wearing a pair of spectacles 41 which have a temple 42 extending along the side of the head of the wearer 40 and around the ear. The housing 11 is attached to the spectacle temple 42 by clip means as earlier described herein, and extends along the side of the head of the wearer 40. As is illustrated, conduit means are provided and include flexible plastic tubing 43 extending between the clean air outlet opening (13 of FIG. 1) of the housing 11 and the coupling member 34 of the nose plug element 32. The plastic tubing 43 is generally pliable and one end thereof is sealingly fitted over the narrow portion 18 of the flute element 17 while the other end is sealingly fitted over the coupling member 34 of the nose plug element 32.

In a preferred embodiment, the tubing 43 is of sufficient length and flexibility to be worn along the path of the temple 42 of the spectacles 41, and around the back of the ear of the wearer 40. In this manner, the conspicuousness of the device may generally be reduced. In another preferred embodiment, the nose plug element 32 provided also has a venting one-way valve means 44 which is operable to exhaust into the atmosphere gases which are exhaled from the nasals. The venting one-way valve means 44 is constructed such that it remains essentially closed while the wearer 40 inhales, but opens when the wearer exhales to vent exhaled gases to the atmosphere. This venting one-way valve means 44 may be a diaphragm-type one-way valve or another suitable one-way valve known in the art, as earlier described herein.

Figure 5:
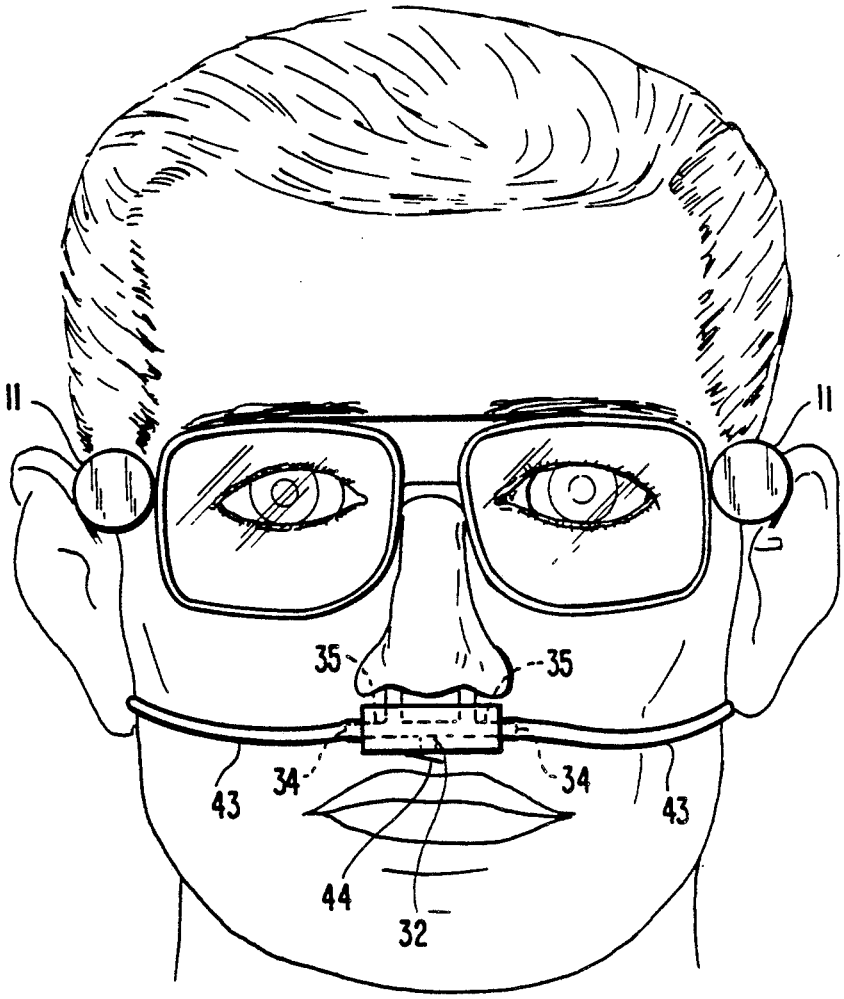
FIG. 5 is a front view of a person wearing spectacles and a dual housing filtration unit.

Referring now to FIG. 5, shown is a front view of the wearer 40 of a dual housing filtration device of FIG. 4. As has been described, the clean air outlet opening (13 of FIGS. 1 and 7) of each housing 11 is connected by a separate length of tubing 43 to its respective coupling member 34 of the nose plug element 32. Thus, the air inhaled through the nose of the wearer is filtered in the housings 11.

Referring now to FIGS. 1 through 7, the operation of the applicant's preferred filtration device will now be more particularly described. Each of the conically shaped nasal plugs 38 is inserted into a corresponding nasal of the wearer 40 and fits snugly and sealingly therein. This supports the nose plug element 32 within and underneath the nose of the wearer 40. With the nose plug element 32 thus in place, when the wearer 40 inhales through the nose, the inhaled air passes through the dirty air inlet opening 12 of the housing 11, through the filter element 45 received within the housing 11, through the apertures 26 in the circular wall 24*b*, through the aperture 21 in the inner wall 20, out of the clean air outlet opening 13 of the housing 11, through the tubing 43, through the nose plug element 32, through the nasal tube elements 36 and nasal plugs 37, and out of the nasal openings 38. Thus, the inhaled gases are filtered by the filter element 45 prior to entering the nasals of the wearer 40.

When the wearer 40 exhales through the nose, the venting one-way valve means 44 opens to vent the exhaled gases to the atmosphere, while the directional one-way valve means including the diaphragm 22 prevents exhaled gases from passing back into the filtration housing.

When the filter element 45 has become contaminated, it may be removed from the housing 11 simply by unscrewing the cap 15 from the front of the housing 11 and slipping the filter element 45 out. The filter element 45 can then be either recycled or simply replaced. It is contemplated by applicant that the filter elements 45 may be constructed of a suitably inexpensive material such that contaminated fiiter elements may simply be disposed and new filter elements placed into the housing 11.

It is also contemplated by applicant that a suitable mouthpiece breather (with or without venting one-way valve means) as known in the art could be provided and connected by tubing to the filtration housings of the applicant's invention herein. Such a mouthpiece could be provided as an alternative to or in addition to a nose plug element, and when in place, would allow air breathed through the mouth of the wearer to be filtered by the filter elements in the housings. Unless another type of material has been specified herein in connection with a particular part, all parts of the applicant's filtration devices can be made of plastic or any other suitable material.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for filtering gases which are inhaled by a wearer of a set of spectacles having a pair of spectacle temples, said device comprising:

a housing having an inlet opening and an outlet opening at spaced positions;

a filter element received in said housing and operable to filter gases moving therethrough;

attachment means for selectively attaching and detaching said housing to one of said temples of said spectacles whereby said housing, while attached, is supported by said temple;

conduit means operable to establish fluid communication between said outlet opening and at least one nostril of said wearer so that the gases inhaled through said nostril move through said housing.

2. The device of claim 1 further comprising directional one-way valve means operable to allow said gases to move through said housing in a first direction from said inlet opening to said outlet opening but to prevent said gases from moving through said housing in a second direction opposite said first direction.

3. The device of claim 2 wherein said conduit means comprise a tube extending between said outlet opening and said nostril.

4. The device of claim 3 wherein said conduit means further comprise a nose plug element, said plug element having a first portion adapted to fit into said nostril, and a second portion adapted to receive an end of said tube.

5. The device of claim 4 wherein said first portion is adapted to fit into both nostrils of said wearer.

6. The device of claim 5 wherein said housing is generally cylindrical in shape and has a plurality of inlet openings.

7. The device of claim 6 further comprising venting one-way valve means associated with said conduit means and operable to open to vent gases passing out of said nostril to the atmosphere, said one-way valve means remaining substantially closed while gases are inhaled into said nostril.

8. The device of claim 1 further comprising venting one-way valve means associated with said conduit means and operable to open to vent gases passing out of said nostril to the atmosphere, said one-way valve means remaining substantially closed while gases are inhaled into said nostril.

9. The device of claim 8 wherein said conduit means comprise:

a tube extending between said outlet opening and said nostril; and, a nose plug element, said plug element having a first portion adapted to fit into said nostril, and a second portion adapted to receive an end of said tube.

10. The device of claim 9 wherein said venting one-way valve means are provided in said nose plug element.

11. The device of claim 10 wherein said first portion of said nose plug element is adapted to fit into both nostrils of said wearer.

12. A filtration device having housings which may be attached to and supported by the temples of a set of spectacles worn by a wearer, said filtration device being operable to filter air inhaled through the nostrils of said wearer, said filtration device comprising:

two generally elongated housings each having a length about equal to or less than the length of said temples, said housings also each having a dirty air inlet opening and a clean air outlet opening at spaced positions;

two filter elements, one received in each of said housings and operable to filter air moving therethrough;

attachment means provided on each of said housings for selectively attaching and detaching said housings to and from said temples of said set of spectacles whereby said housings, while attached, are supported by said temples;

conduit means extending between said outlet openings and said nostrils and adapted so that air inhaled by said wearer moves through said housings.

13. The device of claim 12 further comprising directional one-way valve means associated with each of said housings and operable to allow said gases to move through said housings in a first direction from said inlet openings to said outlet openings but to prevent said gases from moving through said housings in a second direction opposite said first direction.

14. The device of claim 13 wherein said conduit means comprise tubes extending between said outlet openings of said housings and said nostrils.

15. The device of claim 14 wherein said conduit means further comprise a nose plug element, said nose plug element having first and second nasal plugs adapted to fit into said nostrils, and first and second coupling members adapted to receive the ends of said tubes.

16. The device of claim 15 further comprising venting one-way valve means associated with said conduit means and operable to open to vent gases passing out of said nostrils to the atmosphere, said one-way valve means remaining substantially closed while gases pass into said nostrils.

17. The device of claim 12 further comprising venting one-way valve means associated with said conduit means and operable to open to vent gases passing out of said nostril to the atmosphere, said one-way valve means remaining substantially closed while gases pass into said nostril.

18. The device of claim 17 wherein said conduit means comprise:

tubes extending between said outlet openings and said nostrils; and, a nose plug element, said plug element having a first and second nasal plugs adapted to fit into said nostrils, and first and second coupling members adapted to receive the ends of said tubes.

19. The device of claim 18 wherein said venting one-way valve means are provided in said nose plug element and said housing has a plurality of dirty air inlet openings occuring in its side.

20. A filtration housing which may be attached to and supported by the temple of a set of spectacles worn by a wearer, said filtration housing being for use in a device for filtering air inhaled by said wearer, said filtration housing comprising:

a generally elongated housing having a length about equal to or less than the length of said temple, said housing having a dirty air inlet opening and a clean air outlet opening at spaced positions, said housing further being adapted to receive a filter element therein and to filter air moving therethrough when said filter element is received therein;

attachment means provided on said housing for selectively attaching and detaching said housing to and from said temple whereby said housing, while attached, is supported by said temple.

21. The device of claim 1, wherein said attachment means are adapted whereby said housing is supported along said spectacle temple.

22. The device of claim 10, wherein said attachment means are adapted whereby said housing is supported along said spectacle temple.

23. The housing of claim 20, wherein said attachment means are adapted whereby said housing is supported along said spectacle temple.

* * * * *